US007732727B2

(12) United States Patent
Saxl et al.

(10) Patent No.: US 7,732,727 B2
(45) Date of Patent: Jun. 8, 2010

(54) HEAVY-DUTY CIRCUIT-BREAKER WITH SEALING AGAINST HOT GAS

(75) Inventors: David Saxl, Zurich (CH); Stephan Grob, Baden (CH); Markus Vestner, Buesingen (CH)

(73) Assignee: ABB Technology AG, Zurich (CH)

( * ) Notice: Subject to any disclaimer, the term of this patent is extended or adjusted under 35 U.S.C. 154(b) by 398 days.

(21) Appl. No.: 11/812,729

(22) Filed: Jun. 21, 2007

(65) Prior Publication Data

US 2008/0011719 A1 Jan. 17, 2008

Related U.S. Application Data

(63) Continuation of application No. PCT/CH2005/000750, filed on Dec. 14, 2005.

(30) Foreign Application Priority Data

Dec. 23, 2004 (EP) ..... 04405797

(51) Int. Cl.
*H01H 33/00* (2006.01)
*H01H 9/30* (2006.01)

(52) U.S. Cl. ..... 218/51; 218/1; 218/43; 218/59; 218/62; 335/201

(58) Field of Classification Search ..... 218/1, 218/13–14, 17, 19–21, 43, 51, 59, 62–65, 218/72, 89–92, 155; 200/258; 335/8, 15, 335/57, 71, 83, 97, 133, 156, 196, 201–202
See application file for complete search history.

(56) References Cited

U.S. PATENT DOCUMENTS 3,551,624 A * 12/1970 Fischer ..... 218/60

(Continued)

FOREIGN PATENT DOCUMENTS

DE 1 271 241 6/1968

(Continued)

OTHER PUBLICATIONS

Form PCT/ISA/210 (International Search Report) dated Mar. 21, 2006.

(Continued)

*Primary Examiner*—Elvin G Enad
*Assistant Examiner*—Mohamad A Musleh
(74) *Attorney, Agent, or Firm*—Buchanan Ingersoll & Rooney PC

(57) ABSTRACT

The heavy-duty circuit-breaker with arc blowing has an element which is sensitive to hot gas and/or to gas pressure and is protected by means of a seal against a hot-gas flow. The seal is advantageously a movable non-contacting seal. The seal has a channel entrance for production of a partial hot-gas flow of the hot-gas flow and, connected downstream from this, a channel in order to reduce the mass flow of the partial hot-gas flow, and an expansion chamber in order to expand the volume of the partial hot-gas flow. The expansion chamber is a pressure-relief area. The element may, for example, be a guide element, a contact-making element or a sealing element.

27 Claims, 3 Drawing Sheets

U.S. PATENT DOCUMENTS

| | | | | | |
|---|---|---|---|---|---|
| 3,612,799 | A | | 10/1971 | Carter et al. | |
| 3,670,126 | A | | 6/1972 | Roidt | |
| 3,674,957 | A | | 7/1972 | Körner et al. | |
| 3,686,453 | A | * | 8/1972 | Floessel | 218/74 |
| 4,139,752 | A | * | 2/1979 | Itai et al. | 218/43 |
| 4,237,356 | A | * | 12/1980 | Ragaller | 218/62 |
| 4,239,949 | A | * | 12/1980 | Kii et al. | 218/51 |
| 4,684,773 | A | * | 8/1987 | Niemeyer | 218/46 |
| 4,798,924 | A | | 1/1989 | Ackermann | |
| 4,992,634 | A | * | 2/1991 | Thuries et al. | 218/43 |
| 5,483,210 | A | | 1/1996 | Otterberg et al. | |
| 5,898,150 | A | * | 4/1999 | Gallix et al. | 218/66 |
| 5,977,502 | A | * | 11/1999 | Mizoguchi et al. | 218/43 |
| 6,207,917 | B1 | * | 3/2001 | Lehmann et al. | 218/43 |
| 6,730,871 | B1 | * | 5/2004 | Loebner | 218/66 |
| 2004/0057167 | A1 | * | 3/2004 | Claessens et al. | 361/2 |

FOREIGN PATENT DOCUMENTS

| | | | |
|---|---|---|---|
| EP | 0 290 950 | A1 | 11/1988 |

OTHER PUBLICATIONS

Form PCT/ISA/237 (Written Opinion of the International Searching Authority).
European Search Report dated Jun. 16, 2005 (with English translation of category of cited documents).
English translation of Form PCT/ISA/237 (Written Opinion of the International Searching Authority).

* cited by examiner

HEAVY-DUTY CIRCUIT-BREAKER WITH SEALING AGAINST HOT GAS

RELATED APPLICATIONS

This application claims priority under 35 U.S.C. §119 to EP Application 04405797.4 filed in Europe on Dec. 23, 2004, and as a continuation application under 35 U.S.C. §120 to PCT/CH2005/000750 filed as an International Application on Dec. 14, 2005, designating the U.S., the entire contents of which are hereby incorporated by reference in their entireties.

TECHNICAL FIELD

The invention relates to the field of high-voltage switch technology. It relates to a heavy-duty circuit-breaker and to a method for protection of an element, which is sensitive to hot gas and/or to gas pressure, of a heavy-duty circuit-breaker against a hot-gas flow.

BACKGROUND INFORMATION

Arc-quenching heavy-duty circuit-breakers are known from the prior art. A flow of gas (quenching gas, typically $SF_6$) which has been heated by the arc can occur in a such as this. A hot-gas flow such as this can produce considerable pressures and, if it strikes an element which is sensitive to hot gas and/or to gas pressure and may possibly be provided in the heavy-duty circuit-breaker, can damage or destroy an element such as this. Damage to or destruction of an element such as this can lead to malfunctions of the heavy-duty circuit-breaker, or even to failure.

An arc-quenching gas-blast switch provided with a high-pressure reservoir is known from DE 12 71 241, whose arc contact tube can be moved along the switching chamber axis via sliding seals on bearings. During the disconnection process, the arc contact tube is disconnected by the erosion pin, and the quenching gas can expand out of the high-pressure reservoir via a blow-off valve into the switch.

SUMMARY

The object of the invention is therefore to provide a heavy-duty circuit-breaker of the type mentioned initially, which does not have the disadvantages mentioned above, and to provide a method for protection of an element, which is sensitive to hot gas and/or to gas pressure, of a heavy-duty circuit-breaker against a hot-gas flow.

The heavy-duty circuit-breaker according to the invention, in which a hot-gas flow can be formed by an arc which may be struck during a switching process, has an element which is sensitive to hot gas and/or to gas pressure and a seal is provided in order to protect the element against the hot-gas flow, and is characterized in that the seal has a flow-element production means for production of a partial hot-gas flow of the hot-gas flow and, connected downstream from this, a mass-flow reduction means in order to reduce the mass flow of the partial hot-gas flow, and an expansion means in order to expand the volume of the partial hot-gas flow.

The seal allows the pressure and/or temperature of the hot-gas flow to be reduced, so that the element is protected against being damaged by the hot-gas flow.

Pressures and temperatures which occur in hot-gas flows may be greater than 10 bar and greater than 20 bar, and be above 1500 K and above 2000 K.

A seal such as this has the advantage that the mass-flow reduction means can produce a pressure which is less than the pressure of the hot-gas flow, thus resulting in a reduced pressure load on the element, and the expansion means can reduce the temperature of the partial hot-gas flow in comparison to the temperature of the hot-gas flow. The interaction of the parts of the seal results in very effective cooling and pressure reduction, thus resulting in very effective protection of the element against being damaged by the hot-gas flow. The gas flow to which the element is subject is at a lower pressure and a lower temperature than the hot-gas flow.

The expansion means is advantageously arranged downstream from the mass-flow reduction means. In this case, a partial hot-gas flow whose pressure has been reduced by the mass-flow reduction means has its temperature reduced by expansion in the expansion means. However, the mass-flow reduction means can also be arranged downstream from the expansion means.

The seal which is used for cooling and pressure reduction is advantageously a movable non-contacting seal. This makes it possible to protect elements which interact with moving parts of the heavy-duty circuit-breaker.

According to the invention, a seal is arranged between the hot-gas flow and the element which is sensitive to hot gas and/or to gas pressure of a heavy-duty circuit-breaker in order to protect the element against a hot-gas flow, and a partial hot-gas flow is output from the hot-gas flow in the seal, the mass flow of the partial hot-gas flow is reduced, and the volume of the partial hot-gas flow is expanded. This is advantageously done in the stated sequence. In other words, the element which is sensitive to hot gas and/or to gas pressure is protected by a seal against a hot-gas flow.

In one preferred embodiment, the mass flow of the partial hot-gas flow in the mass-flow reduction means is essentially caused by production of internal friction within the partial hot-gas flow. This is advantageously achieved by offering the partial hot-gas flow a small cross section through which it can flow. This results in the mass flow being reduced in a simple manner. This also results in the advantage that parts of the heavy-duty circuit-breaker which are adjacent to the mass-flow reduction means can absorb heat from the partial hot-gas flow, so that the mass-flow reduction means at the same time also acts as a means for reducing the temperature of the partial hot-gas flow.

The flow-element production means advantageously has a gap, or is only a gap. The gap may also be a component of the mass-flow reduction means or of the expansion means. This results in the flow-element production means being provided in a simple manner.

In one preferred embodiment, the mass-flow reduction means has a channel. A channel such as this is advantageously elongated, and is advantageously narrow. The channel may extend along an axis and, in one advantageous embodiment, may be in the form of an annular channel.

The flow-element production means may also be integrated in the expansion means or in the mass-flow reduction means. In particular, the mass-flow reduction means may be in the form of a channel, and the flow-element production means may be in the form of that end of the channel which is on the hot-gas flow side.

In one particularly preferred embodiment, the expansion means has a pressure-relief area which is open towards the element, or is formed by such an area. The only function of the pressure-relief area is pressure relief, that is to say it does not contain any other elements such as contact elements, guide elements or sealing elements.

However, it may also be highly advantageous for the functions of the flow-element means, of the mass-flow reduction means to form a gap with respect to one another, which is a component of the pressure-relief area, so that the functions of the flow-element means, of the mass-flow reduction means and of the expansion means are embodied by one element.

The partial hot-gas flow is advantageously offered an increasing cross-sectional area on entering the expansion means.

On emerging from the flow-element production means or the mass-flow reduction means, the partial hot-gas flow flows through a cross-sectional area of a specific size, and the cross-sectional area offered to the partial hot-gas flow in the expansion means is larger than this. This leads to expansion of the volume of the partial hot-gas flow, and this in turn leads to a reduction in the temperature of the partial hot-gas flow.

The expansion means advantageously has at least one pressure-relief opening, through which the expansion means is connected to a reservoir volume, which contains gas whose temperature is at most as high as the temperature of the hot-gas flow, and/or whose pressure is at most as high as the pressure of the hot-gas flow. The temperature and/or pressure in the reservoir volume are advantageously less than the temperature and pressure in the hot-gas flow.

In one preferred embodiment, the element is

- a guide element for mechanical guidance of a first part of the heavy-duty circuit-breaker, which can move with respect to a second part of the heavy-duty circuit-breaker, or is
- a contact-making element for making electrical contact with a first part of the heavy-duty circuit-breaker, which can move with respect to a second part of the heavy-duty circuit-breaker, or is
- a sealing element for sealing of a first part of the heavy-duty circuit-breaker from a second part of the heavy-duty circuit-breaker, with the first part being movable with respect to the second part.

The element may also have a combined function. For example, it may act as a guide and have a sealing function at the same time.

If the relative speeds are very high, a seal according to the invention can be used between such first and second parts of the heavy-duty circuit-breaker; for example, if at least one of the parts is coupled to the drive movement for switching of the switch, relative speeds of more than 10 m/s and more than 15 m/s can occur between the first and the second part.

The first part of the heavy-duty circuit-breaker may extend at least partially along an axis. The mass-flow reduction means can advantageously extend along an axis.

The mass-flow reduction means and/or the expansion means are/is advantageously adjacent to the first part.

A holder can be provided for holding the element. This can advantageously contribute at least partially to the formation of a further channel, which connects the element to the expansion means (pressure-relief area).

In one advantageous embodiment, a holder is provided for holding the element, and is formed integrally with the seal. This simplifies the production of these heavy-duty circuit-breaker components and makes it possible to ensure a defined fixed arrangement of these heavy-duty circuit-breaker components.

In the case of elements which are particularly sensitive to hot gas and/or to gas pressure, or if hot-gas flows at a particularly high temperature and/or at a particularly high pressure occur, two or more seals can advantageously be provided, and are arranged one behind the other (in series).

It is also possible for the invention to be implemented in the form of a seal with a flow-element production means and, connected downstream from it, a mass-flow reduction means and an expansion means. A seal such as this can be used in a heavy-duty circuit-breaker or else in any other desired apparatuses in which hot-gas flows occur and an element must be protected against such a hot-gas flow. Advantageous embodiments are possible in the manner described above.

Further preferred embodiments and advantages will become evident from the dependent patent claims and from the figures.

BRIEF DESCRIPTION OF THE DRAWINGS

The subject matter of the invention will be explained in more detail in the following text with reference to preferred exemplary embodiments, which are illustrated in the attached drawings, in which, schematically.

Figure 1:
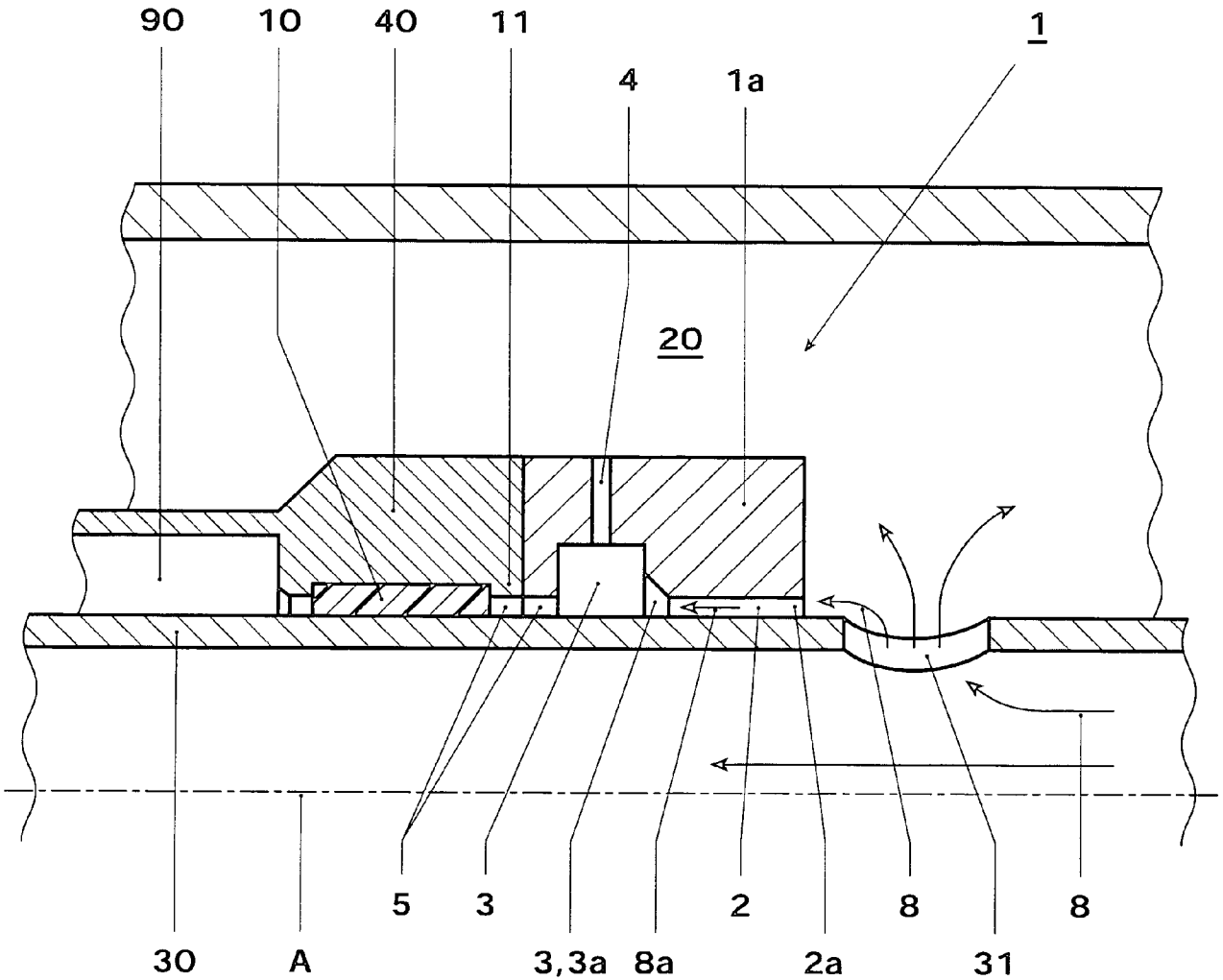
FIG. 1 shows a detail of a heavy-duty circuit-breaker with a guide and a seal according to the invention, sectioned.

The reference symbols used in the drawings, and their meanings, are listed in summarized form in the list of reference symbols. In principle, identical parts or parts having the same effect are provided with the same or similar reference symbols in the figures. Parts which are not essential to the understanding of the invention are in some cases not illustrated. The described exemplary embodiments are examples relating to the subject matter of the invention, and have no restrictive effect.

DETAILED DESCRIPTION

FIG. 1 shows, schematically and in the form of a section, a detail of an essentially rotationally symmetrical heavy-duty circuit-breaker with an axis A. A hot-gas flow 8 flows (symbolized by arrows) through an outlet-flow tube 30 which can move along the axis A with respect to a second part 40 of the heavy-duty circuit-breaker. The hot gas can flow out of the outlet-flow tube through an opening 31. A guide 10, which is arranged outside the outlet-flow tube 30, is provided in order to guide (center) the part 40 with respect to the outlet-flow tube 30, for example a hollow-cylindrical piece made of PTFE with additives or some other polymer. The guide is held in a holder 11.

In order to protect the guide 10 against degradation by the hot-gas flow 8 emerging from the outlet-flow tube, a seal 1 is provided between the opening 31 and the guide 10, is connected to the holder 11 and is formed in a sealing body 1*a*. The seal 1 has an elongated channel 2 which, because of the rotational symmetry, is in the form of an annular channel, and by means of whose end 2*a* facing the hot-gas flow 8 a partial hot-gas flow 8*a* is separated from the hot-gas flow 8.

The partial hot-gas flow 8*a* flows through the narrow channel 2 and on to a pressure-relief area 3 which, adjacent to the channel 2, has an optional subarea 3*a*, which opens in the form of a funnel, of the pressure-relief area 3.

The flow speed of the partial hot-gas flow 8*a* is limited by the speed of sound of the hot gas, and the small cross section that is available for the partial hot-gas flow 8*a* to flow through in the channel 2 results in considerable internal friction in the gas of the partial hot-gas flow 8*a*. This considerably reduces the mass flow of the partial hot-gas flow 8*a* in the channel 2. The pressure of the hot gas at the end of the channel 2 on the pressure-relief area side is thus considerably lower than the hot-gas pressure in the hot-gas flow 8.

The magnitude of the pressure reduction caused by the channel 2 in the partial hot-gas flow 8*a* can be achieved by variation of the length of the channel 2 and its cross section.

As a further effect, the temperature of the partial hot-gas flow 8*a* is reduced by the contact of the partial hot-gas flow 8*a* with the sealing body 1*a* and with the outlet-flow tube 30, the two of which bound the channel 2 and are in general at a considerably lower temperature than the partial hot-gas flow 8*a*. This effect can also be varied by variation of the length of the channel 2 and its cross section.

As it passes from the channel 2 to the pressure-relief area 3, the partial hot-gas flow 8*a* is presented with a larger cross-sectional area to flow through (for example with a continuously enlarging cross section, as in the subarea 3*a* illustrated in the figure). The hot gas is expanded. The expansion of the hot gas in the pressure-relief area 3 results in the hot gas being cooled down. The reduction in the temperature of the hot gas can be varied by varying the volume of the pressure-relief area 3 and/or the increase in the cross-sectional area in the change from the channel 2 to the pressure-relief area 3.

The pressure-relief area 3 is connected to the guide 10 by a further channel 5 which, in the exemplary embodiment illustrated in FIG. 1, is formed by the holder 11 and a part of the sealing body 1*a*.

A further function of the subarea 3*a* is to broaden or to fan-out the flow profile of the partial hot-gas flow emerging from the channel 2, so that less pressure is exerted on the further channel 5, which is opposite the channel 2, than would be the case without the subarea 3*a*.

The guide 10 is subjected to hot gas at a lower pressure and at a lower temperature than would be the case in the hot-gas flow 8.

The seal 1 does not touch the outlet-flow tube 30, and to this extent is a non-contacting seal. It can therefore be used when the relative speeds between the parts 30, 40 are very high.

In order to prevent an excessively major rise in the pressure in the pressure-relief area 3, at least one pressure-relief opening 4 is provided, through which the pressure-relief area 3 is connected to an exhaust volume 20, which is used as a reservoir volume 20. The area in which the hot-gas flow 8 strikes the channel 2 can be completely separated from the reservoir volume 20, or can be connected to it via an opening of greater or lesser size. Greater separation allows a greater pressure drop from the pressure-relief area 3 to the reservoir volume 20, so that the pressure-relief opening 4 can be effective even at relatively low pressures.

It may be advantageous to provide a plurality of pressure-relief openings 4 distributed over the circumference of the sealing body 1*a*.

Apart from decreasing the risk of the hot-gas flow 8 damaging the guide, the seal 1 can also ensure that less hot gas, and thus less contamination, reaches the seal 1 and enters an area 90 arranged beyond the seal 1. This can be particularly important when electrically isolating parts form an isolating gap in this area 90, across which flashovers, and corresponding switch malfunctions, could occur in the event of contamination of the isolating parts. The guide 10 also has a sealing effect.

The seal is advantageously designed, particularly by the choice of its dimensions, such that, on the one hand, the temperature to which the element 10 (guide) to be protected is subject is so low that it is not damaged and, on the other hand, the pressure to which the guide 10 is subject is so low that the guide 10 has an adequate sealing effect for the area 90 behind it.

The sealing body 1*a* (at least in the area of the channel 2) is advantageously composed of a temperature-resistant material such as ceramic, tungsten, tungsten carbide or steel.

Figure 2:
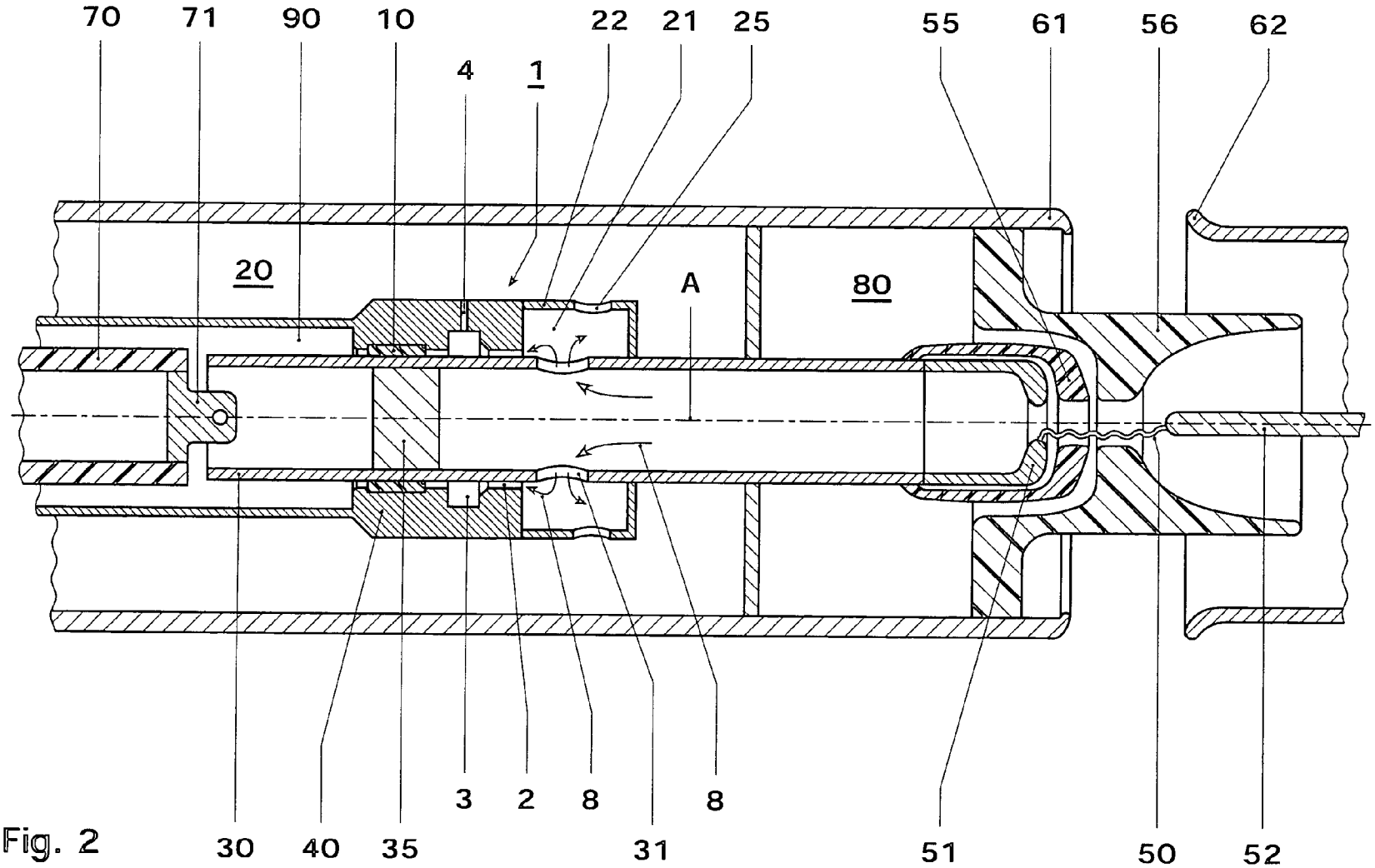
FIG. 2 shows a larger part of a heavy-duty circuit-breaker with a guide and a seal according to the invention, sectioned.

FIG. 2 shows a larger detail of a heavy-duty circuit-breaker in the open state, designed in a similar manner to the heavy-duty circuit-breaker illustrated in FIG. 1. In this case, the seal 1 is formed integrally with the part 40 of the heavy-duty circuit-breaker.

In addition to a rated-current contact system 61, 62, the heavy-duty circuit-breaker also has a first arc contact piece 51 and a second arc contact piece 52, between which an arc 50 is struck for a few milliseconds up to a few tens or a few hundreds of milliseconds during a disconnection process. The contact piece 51 is surrounded by an auxiliary nozzle 55. Together with the auxiliary nozzle, a main nozzle 56 forms a connection between the arcing area and a heating volume 80, which accommodates a portion of the gas which has been heated by the arc 50. Another portion of the heated gas flows through the outlet-flow tube 30 in the direction facing away from the second contact piece 52.

Assisted by a gas-flow diverter 35 which closes the outlet-flow tube 30, at least a portion of the hot-gas flow 8 will flow through the opening 31 and against the seal 1. The function and details of the seal 1 correspond essentially to that described further above. A tank 22 bounds a thorough-mixing volume 21 in which the hot gas from the hot-gas flow 8 can be mixed thoroughly with cooler, cleaner gas. The area bounded by the tank 22 can also be referred to as an inlet-flow area 21, since it also has the function of bounding the area in which the hot-gas flow 8 flowing to the seal 1 is provided. The thorough-mixing volume 21 is connected to the reservoir volume 20 through an opening 25. The high degree of separation of the inlet-flow volume 21 from the reservoir volume 20 allows the pressure (as well as the temperature) in the reservoir volume 20 to be kept lower, at least for a certain time period, than in the thorough-mixing volume 21. This assists the pressure-limiting effect of the pressure-relief opening or openings 4 for the pressure-relief area 3.

The outlet-flow tube 30 is coupled to an isolating rod 70 by means of a joint 71, and the isolating rod 70 is in turn connected to a drive, which is not illustrated. The guide 10 ensures linear movement of the outlet-flow tube 30 along the axis A, while the isolating rod 70 carries out an angular movement on a plane which includes the axis A. Furthermore, the guide 10 has a sealing function which is intended to prevent the hot gas from entering the area 90 in order to ensure that no flashovers occur in the area where the field strength is high close to the isolating rod. Flashovers such as these can be assisted by adsorption of impurities contained in the hot gas on the surface of the isolating rod 70 and by lack of dielectric strength of the gas in the area of the isolating rod (pressure, temperature, impurities).

Because of the short-term nature of the arc and the large amount of energy released during arc quenching, the hot-gas flow 8 is essentially caused by a pressure surge, and therefore has a correspondingly short duration. The seal 1 is particularly highly suitable for protection against hot-gas pressure surges 8 such as these.

Figure 3:
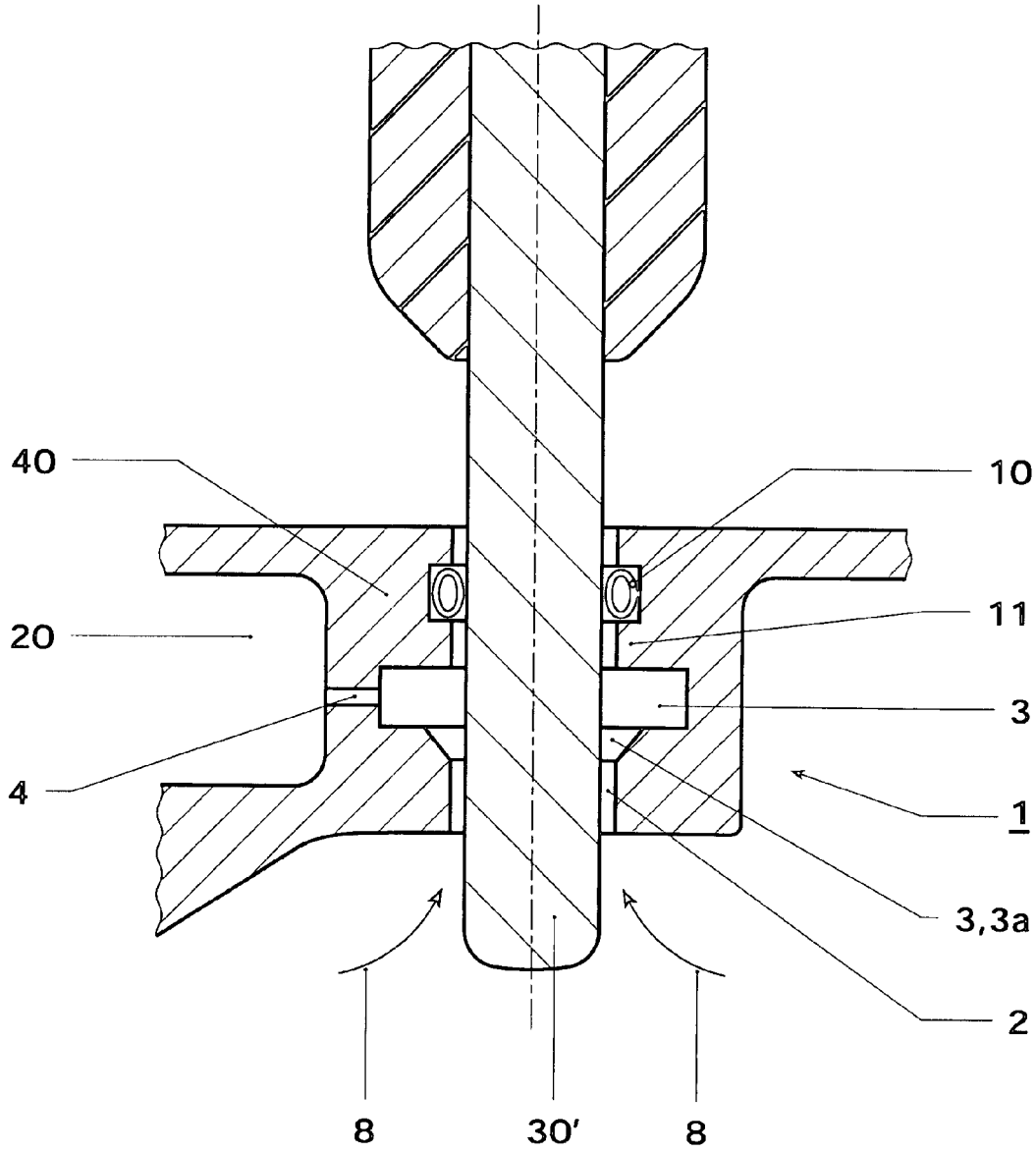
FIG. 3 shows a bushing with a contact-making and/or sealing element, and with a seal according to the invention.

FIG. 3 shows, schematically and in the form of a section, a further embodiment of the invention. Either a seal 10 or a contact-making element 10 is provided as the element 10 to be protected against a hot-gas flow 8. FIG. 3 can be interpreted in at least these two ways. A bushing 30' is provided, which may be part of a heavy-duty circuit-breaker, or else may be provided in other apparatuses, for example other high-voltage appliances. The part 30' may, for example, also be a preferably moving contact piece of a heavy-duty circuit-breaker. In this case, the part 30' need not necessarily be provided with insulation, as is provided on the part 30' in FIG. 3. By way of example, the contact-making element 10 may have contact laminates. It is particularly advantageous to use the seal 1 for a switch with two movable contact pieces, for example an arc contact piece 30' and a contact tulip (not shown in FIG. 3). The movable contact-making element 10 is then protected against the hot-gas flow which is produced by an arc based on the arc contact piece 30'.

The capability of the two parts 30, 40' (or 30, 40) to move with respect to one another need not be a linear movement capability but may, for example, also be a capability to rotate or simply a capability to move with respect to one another in the sense of play or an adjustment capability.

In the situation in which the element 10 is a seal, this may, for example, be composed of a polymer and can prevent the ingress of gas or liquid into the area of the hot-gas flow 8 and/or the emergence of hot gas from the hot-gas flow 8. The seal 1 is intended to protect the sealing element 10 and is essentially designed in the same way, and has the same functional principle as that illustrated in FIG. 1.

In the situation in which the element 10 is a contact-making element 10, it may, for example, be a multi-contact ring 10 or a spiral-spring contact element 10, and may be used to create a detachable electrical contact between the (electrical) bushing 30' and the second part 40. In this case as well, the seal 1 is essentially designed the same and has the same functional principle as that illustrated in FIG. 1.

"Protection against a hot-gas flow" by means of the seal can be understood as meaning that the temperature and/or the pressure of a gas are/is reduced by the seal. The hot-gas flow may be continuous (permanent) or, as in the case of the embodiments of a heavy-duty circuit-breaker as described in conjunction with FIGS. 1 and 2, may be of short duration and in the form of a pressure surge. In heavy-duty circuit-breaker applications, the hot-gas pressure surge typically lasting for 10 ms to 200 ms results in pressures of typically 10 bar to 25 bar and in temperatures of 1000 K to 2500 K. Lesser and greater pressures and temperatures are also conceivable, in the case of other applications of the seal.

The seal according to the invention can also be referred to as a protective apparatus against high-pressure gas, as a protective apparatus against high-temperature gas, or as a protective apparatus against high-pressure and high-temperature gas; alternatively, it may be regarded as a protective device against high-pressure gas pulses or as a protective device against gas pulses, in particular high-temperature, high-pressure gas pulses.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

| List of Reference Symbols | |
|---|---|
| 1 | Seal |
| 1a | Sealing body |
| 2 | Mass-flow reduction means, channel |
| 2a | Flow-element production means, gap |
| 3 | Expansion means, pressure-relief area |

-continued

| List of Reference Symbols | |
|---|---|
| 3a | Subarea, funnel-like area, area with a cross-sectional area which increases in steps or continuously |
| 4 | Pressure-relief opening |
| 5 | Further channel |
| 8 | Hot-gas flow, hot-gas pressure surge |
| 8a | Partial hot-gas flow |
| 10 | Element, element which is sensitive to hot gas, element which is sensitive to gas pressure, guide, contact-making element, spiral contact ring, sealing element, seal |
| 11 | Holder |
| 20 | Reservoir volume, exhaust volume |
| 21 | Inlet-flow area, thorough-mixing volume |
| 22 | Tank (forming the inlet-flow area; containing the thorough-mixing volume) |
| 25 | Opening in the tank, opening between the reservoir volume and the inlet-flow volume |
| 30 | First part, first part of the heavy-duty circuit-breaker, outlet-flow tube |
| 30' | First part, bushing conductor |
| 31 | Opening in the first part (of the heavy-duty circuit-breaker), opening in the outlet-flow tube |
| 35 | Gas-flow diverter |
| 40 | Second part, second part of the heavy-duty circuit breaker |
| 50 | Arc |
| 51 | First contact piece, arc contact piece, moving contact piece |
| 52 | Second contact piece, arc contact piece, stationary contact piece |
| 55 | Auxiliary nozzle |
| 56 | Nozzle, main nozzle |
| 61 | Rated-current contact piece |
| 62 | Rated-current contact piece |
| 70 | Isolating rod, drive rod, switching rod |
| 71 | Coupling between the isolating rod and the outlet-flow tube, joint |
| 80 | Heating volume |
| 90 | Area |
| A | Axis |

What is claimed is:

1. A heavy-duty circuit-breaker, in which a hot-gas flow can be formed by an arc which may be struck during a switching process, comprising:

first and second contact pieces;

an element which is sensitive to at least one of hot gas and gas pressure; and a seal provided in order to protect the element against the hot-gas flow, the seal including:

a channel entrance for introduction of a partial hot-gas flow of the hot-gas flow, a channel connected downstream of the channel entrance in a hot-gas flow direction to reduce the mass flow of the partial hot-gas flow, and an expansion chamber arranged in an interior portion of the seal to expand the volume of the partial hot-gas flow.

2. The heavy-duty circuit-breaker as claimed in claim 1, wherein the seal is a movable seal and does not contact an outlet flow tube.

3. The heavy-duty circuit-breaker as claimed in claim 1, wherein the channel has a cross section through which flow can pass such that the mass flow of the partial hot-gas flow is essentially caused by production of internal friction in the partial hot-gas flow.

4. The heavy-duty circuit-breaker as claimed in claim 1, wherein the channel entrance has a gap.

5. The heavy-duty circuit-breaker as claimed in claim 1, wherein the channel is annular.

6. The heavy-duty circuit-breaker as claimed in claim 1, wherein the expansion chamber has a pressure-relief area which is open towards the element and is used as the only pressure-relief means.

7. The heavy-duty circuit-breaker as claimed in claim 1, wherein the expansion chamber includes a gradually increasing cross-sectional area.

8. The heavy-duty circuit-breaker as claimed in claim 7, gradually increasing cross-sectional area increases continuously or in steps.

9. The heavy-duty circuit-breaker as claimed in claim 8, wherein the expansion chamber has at least one pressure-relief opening, through which the expansion chamber is connected to a reservoir volume, which contains gas whose temperature is at most as high as the temperature of the hot-gas flow, and/or whose pressure is at most as high as the pressure of the hot-gas flow.

10. The heavy-duty circuit-breaker as claimed in claim 1, wherein the expansion chamber has at least one pressure-relief opening, through which the expansion chamber is connected to a reservoir volume, which contains gas whose temperature is at most as high as the temperature of the hot-gas flow, and/or whose pressure is at most as high as the pressure of the hot-gas flow.

11. The heavy-duty circuit-breaker as claimed in claim 10, wherein the element is a guide element for mechanical guidance of a first part of the heavy-duty circuit-breaker, which can move with respect to a second part of the heavy-duty circuit-breaker.

12. The heavy-duty circuit-breaker as claimed in claim 10, wherein the element is a contact-making element for making electrical contact with a first part of the heavy-duty circuit-breaker, which can move with respect to a second part of the heavy-duty circuit-breaker.

13. The heavy-duty circuit-breaker as claimed in claim 10, wherein the element is a sealing element for sealing of a first part of the heavy-duty circuit-breaker from a second part of the heavy-duty circuit-breaker, with the first part being movable with respect to the second part.

14. The heavy-duty circuit-breaker as claimed in claim 1, wherein the element is a guide element for mechanical guidance of a first part of the heavy-duty circuit-breaker, which can move with respect to a second part of the heavy-duty circuit-breaker.

15. The heavy-duty circuit-breaker as claimed in claim 14, wherein the first part of the heavy-duty circuit-breaker extends at least partially along an axis (A), and the channel extends along this axis (A).

16. The heavy-duty circuit-breaker as claimed in claim 15, wherein at least one of the channel and the expansion chamber is adjacent to the first part.

17. The heavy-duty circuit-breaker as claimed in claim 14, wherein at least one of the channel and the expansion chamber is adjacent to the first part.

18. The heavy-duty circuit-breaker as claimed in claim 17, wherein a holder is provided for holding the element and contributes at least partially to the formation of a further channel, which connects the element to the expansion chamber.

19. The heavy-duty circuit-breaker as claimed in claim 1, wherein a holder is provided for holding the element and contributes at least partially to the formation of a further channel, which connects the element to the expansion chamber.

20. The heavy-duty circuit-breaker as claimed in claim 19, wherein a holder is provided for holding the element, and is formed integrally with the seal.

21. The heavy-duty circuit-breaker as claimed in claim 1, wherein a holder is provided for holding the element, and is formed integrally with the seal.

22. The heavy-duty circuit-breaker as claimed in claim 21, wherein at least two such seals are provided, arranged in series.

23. The heavy-duty circuit-breaker as claimed in claim 1, wherein at least two such seals are provided, arranged in series.

24. The heavy-duty circuit-breaker as claimed in claim 1, wherein the element is a contact-making element for making electrical contact with a first part of the heavy-duty circuit-breaker, which can move with respect to a second part of the heavy-duty circuit-breaker.

25. The heavy-duty circuit-breaker as claimed in claim 1, wherein the element is a sealing element for sealing of a first part of the heavy-duty circuit-breaker from a second part of the heavy-duty circuit-breaker, with the first part being movable with respect to the second part.

26. A method for protection of an element, which is sensitive to at least one of a hot gas and gas pressure, of a heavy-duty circuit-breaker including first and second contact pieces, against a hot-gas flow, with a seal being arranged between the hot-gas flow and the element, the seal including a channel entrance for introduction of a partial hot-gas flow of the hot-gas flow, a channel connected downstream of the channel entrance in a hot-gas flow direction to reduce the mass flow of the partial hot-gas flow, and an expansion chamber arranged in an interior portion of the seal to expand the volume of the partial hot-gas flow, the method, comprising:

outputting the partial hot-gas flow from the hot-gas flow into the channel entrance in the seal;

reducing the mass flow of the partial hot-gas flow in the channel; and expanding the volume of the partial hot-gas flow in the expansion chamber.

27. A heavy-duty circuit-breaker, in which a hot-gas flow can be formed by an arc which may be struck during a switching process, comprising: first and second contact pieces; an element which is sensitive to at least one of hot gas and gas pressure; and a seal provided in order to protect the element against the hot-gas flow, the seal including: a channel entrance for introduction of a partial hot-gas flow of the hot-gas flow, a first channel connected downstream of the channel entrance in a hot-gas flow direction to reduce the mass flow of the partial hot-gas flow, an expansion chamber to expand the volume of the partial hot-gas flow, and a second channel arranged downstream of the expansion chamber.

* * * * *